US005266167A

United States Patent [19]

Hess et al.

[11] Patent Number: 5,266,167

[45] Date of Patent: Nov. 30, 1993

[54] METHOD OF ROLL COOLING IN A PAPER MACHINE

[75] Inventors: Harald Hess, Gruenkraut; Herbert Holik, Ravensburg; Rüdiger Kurtz, Immenstaad a.B.; Juergen Proessl, Weingarten, all of Fed. Rep. of Germany

[73] Assignee: Sulzer-Escher Wyss GmbH, Ravensburg, Fed. Rep. of Germany

[21] Appl. No.: 903,024

[22] Filed: Jun. 23, 1992

[30] Foreign Application Priority Data

Jun. 28, 1991 [DE] Fed. Rep. of Germany ..... 4121381

[51] Int. Cl.[5] ..... D21G 1/00

[52] U.S. Cl. ..... 162/206; 100/38; 100/93 RP

[58] Field of Search ..... 162/206, 375; 100/38, 100/93 R, 93 P, 153, 102, 155 R

[56] References Cited

U.S. PATENT DOCUMENTS 5,033,373 7/1991 Brendel et al. ..... 100/38

*Primary Examiner*—W. Gary Jones
*Assistant Examiner*—Dean Tan Nguyen
*Attorney, Agent, or Firm*—Townsend and Townsend, Khourie and Crew

[57] ABSTRACT

The invention relates to a method for roll cooling in paper machines with soft smoothing mechanisms. The object of the invention is to protect the soft roll from damage without having to increase the extent of edge trimming of the paper web. This is achieved in that the parts of the soft roll which respectively project beyond the width of the paper web are cooled by the application of a thin and sharply bounded water film. The corresponding devices for generating the water films are mounted in carriages which are displaceable along a transverse beam parallel to the roll.

4 Claims, 1 Drawing Sheet

METHOD OF ROLL COOLING IN A PAPER MACHINE

FIELD OF THE INVENTION

The invention relates to a method and to an apparatus for roll cooling in paper machines with so called soft smoothing mechanisms.

BACKGROUND TO THE INVENTION

In such mechanisms the paper web is passed for smoothing through at least one roll pair which consists of a soft roll and a heated counter roll. The invention can, however, basically also be used in machines for manufacturing other fiber webs, mats or fleeces.

The paper web is subjected to deviations with respect to its position and width which arise for technological and type related reasons. This can lead to thermal destruction of the ends of the soft roll as a result of the high temperature of the heated counter roll necessary for a high degree of glazing and the contact between the two rolls which takes place under a high line pressure. Damage to/or destruction of the soft roll makes it necessary to exchange the roll.

BRIEF DESCRIPTION OF THE PRIOR ART

In DE-OS 39 07 216 a method is therefore proposed in which the width of the calendered web, which is guided through the roll gap, is at least as large as the width of the soft roll. In order to ensure protection of the soft roll even when the shrinkage conditions change or when the paper web "wanders" in the paper machine, the paper web must however be considerably broader than the soft roll. This makes it necessary to trim off the non-calendered edge strip of the paper web and this significantly increases the production losses.

In the solution described in DE 40 37 166.2 the regulation of the width of the paper web takes place via the edge jets in the sieve section of the paper machine, with the paper web being made at most 50 mm smaller than the shorter roll. This arrangement is however associated with a considerable degree of cost and complexity. The edge jets which separate away the edge strips of the paper web with a spray of liquid are transversely moveable relative to the paper web. This means that an adjusting unit, for example in the form of a spindle drive, and measurement transducers are required to detect the edges of the paper web and thus the precise position of the paper web relative to the smoothing rolls. These measurement transducers which can be formed as a light barrier with a diode chain, and which are intended to improve the control accuracy, are located at a plurality of positions. A feed-back regulation circuit connected to the measurement transducers acts on the adjustment unit for the edge jets. The reference also discloses the provision of guide rolls for position stabilisation of the paper web, these guide rolls being of regulatable angle with respect to the paper web.

OBJECT OF THE INVENTION

The object of the invention is to provide a method and a simply designed apparatus which protects the soft roll from damage without having to enlarge the required edge trimming of the paper web.

BRIEF DESCRIPTION OF THE INVENTION

In accordance with the invention, this object is satisfied by a method of roll cooling in paper machines in which a paper web to be calendered is led through at least one roll pair consisting of a soft roll and a heated counter roll, with the parts of the soft roll which project beyond the width of the paper web being cooled by the application of a thin and sharply bounded water film.

A suitable apparatus for effecting roll cooling in paper machines with at least one calender roll pair consisting of a soft roll and a heated counter roll is characterized in that, there is provided, at each of the ends of the soft roll, a respective device for applying a water film to the soft roll, with the device being mounted in a carriage which can be displaced along a transverse beam parallel to the soft roll.

The application of a sufficiently thin water film to the parts of the soft roll which respectively extend beyond the paper web protects the soft roll from thermal destruction through the heated counter roll. Means should however be taken to prevent the water entering into the roll gap, for example to avoid the wetting of the paper web.

Additional cooling can be advantageous and can be generated by blowing air onto the water film so as to exploit the evaporative cooling effect. Amongst other things this permits the degree of cooling to be increased with a minimal amount of water.

The water film should expediently be applied in a thickness which precludes the introduction of water into the roll gap.

It is particularly convenient to arrange measurement transducers for the detection of the edges of the paper web upstream of the entry of the paper web into the calender roll pair. These measurement transducers are conveniently connected to a feed-back regulation circuit which acts on the position of the carriages carrying the devices for the application of the water film.

An adaptation to the position and width of the paper web is thus possible by simple regulation and also by the displaceable arrangement of the two water film application devices on a transverse beam extending parallel to and along the soft roll.

The devices for blowing air onto the water film are conveniently also mounted on the carriages following the devices for applying the water film, that is to say downstream of these devices as seen in the direction of movement of the surface of the soft roll.

The water film itself is conveniently generated via a metered water supply with the aid of at least one of a brush, a felt, a sponge, a spray device or the like. If a brush, a felt or a sponge or the like is used for transferring the film of water to the soft roll then the thickness of the water film can then be controlled via the contact pressure of the water supply device operating on the base of the brush, felt or sponge or the like.

Further advantageous embodiments of the invention are set forth in the subordinate claims.

BRIEF DESCRIPTION OF THE DRAWINGS

The invention will now described in more detail in the following with reference to an embodiment. In the accompanying drawings FIG. 1 is a schematic plan view of the apparatus while

DESCRIPTION OF A PREFERRED EMBODIMENT

Figure 1:
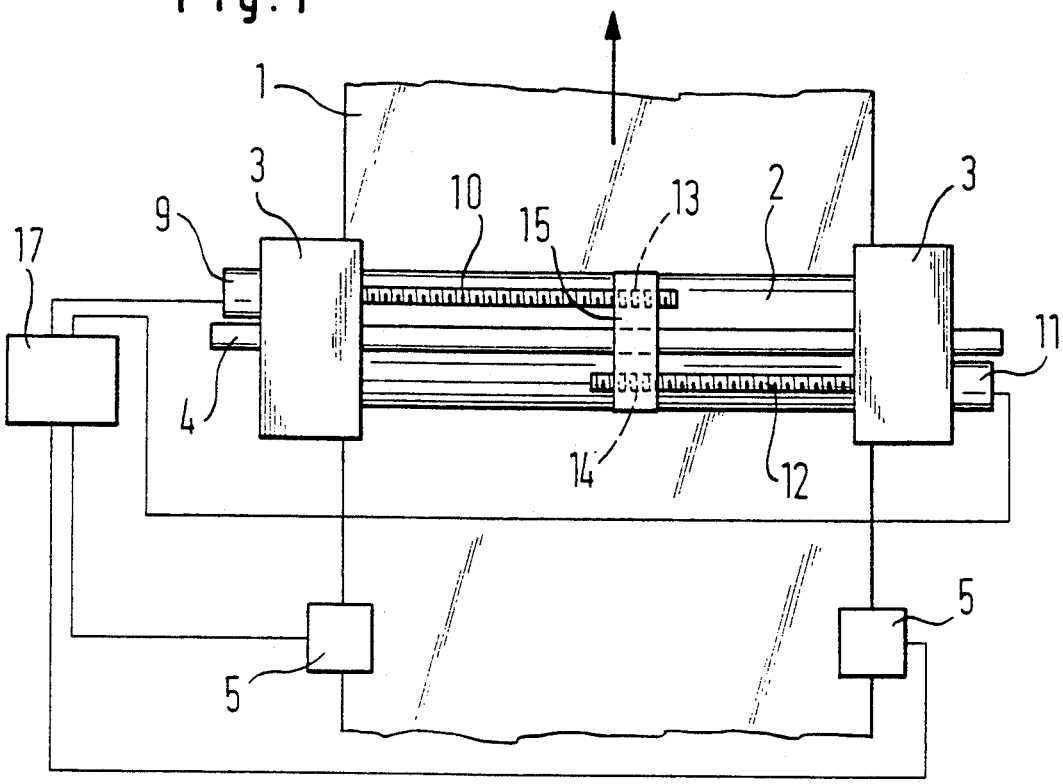
Figure 2:
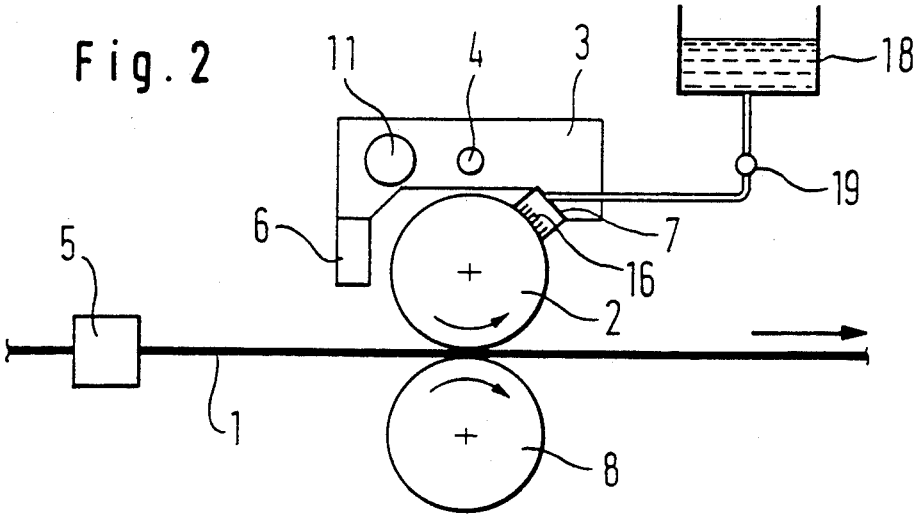
FIG. 2 shows a schematic side view of the same apparatus.

FIGS. 1 and 2 show a smoothing roll mechanism in the form of a roll pair consisting of a soft roll 2 and a heated counter roll 8 which define a roll gap between them. The paper web 1 runs through the roll gap in the direction of the arrow with simultaneous rotation of the two rolls of the roll pair about their respective axes. As seen in FIG. 2 the upper soft roll 2 moves in the counter clockwise direction whereas the lower heated counter roll 8 moves in the clockwise direction. Respective devices 7 are provided one at each of the respective axial ends of the soft roll 2 for the application of a thin sharply delimited water film to the soft roll 2, in accordance with the method of the invention. The expression sharply delimited or bounded as used herein means that the axial limits of each of the films of water at the two ends of the soft roll are clearly defined. The devices 7 are each mounted on a respective carriage 3 for movement along a transverse beam 4 parallel to the roll 2. Movement of the left hand carriage 3 of FIG. 1 is effected by the positioning motor 9 and the lead screw 10, whereas the movement of the right hand carriage is effected by the positioning motor 11 and the lead screw 12. Thus the carriages can be moved separately if desired. The motors can however be jointly controlled for simultaneous movement of the carriages in the same direction if desired, e.g. to follow a "wandering" paper web moving axially to and fro in the transverse direction.

Each lead screw 10, 12 runs in a respective ball nut 13, 14, fixedly mounted in a bridge piece 15 at the center of the beam 4 to produce movement of the carriages.

The water film itself is thereby generated from a metered supply of water 18 with the aid of a brush 16. Alternatively, a felt, a sponge, a spray device or the like could be substituted for the brush 16. If a brush, a felt or a foam is used for this purpose, the amount of water applied to the soft roll can be varied in one of a number of ways. It is, for example, possible to restrict the amount of water supplied to the brush, felt or foam via a restrictor, preferably an adjustable restrictor 19, in the supply line or by varying the pressure of contact between the brush, felt or foam and the soft roll which varies the water transport through the respective element. If a spray device is used then the rate of application of water can be varied, for example, by varying the rate at which water is pumped to the spray device. Another alternative would be to apply a thin film of water to a rotating wheel (optionally scraping off excess water from the rotating wheel with a doctor blade) and with the rotating wheel contacting the associated end of the soft roll and transferring the water film to it on co-rotation of the soft roll and the transfer roll.

In order to promote evaporation of the water film prior to its entry into the roll gap, and thus to promote the cooling, devices 6 are secured to the carriage 3 following the application of the water film and the devices 6, one for each of the devices 7, and blow air onto the respective water film via corresponding nozzles.

For the automatic adaptation to the position and width of the paper web, respective measurement transducers 5 in the form of a light barrier with a diode chain for detecting the edges of the paper web are arranged upstream of the entry of the paper web 1 into the calender roller pair 2, 8 at the guide side and the drive side of the paper web in order to detect the edges of the paper web. These measurement transducers are connected with a regulator 17 of known kind which acts on the position motors 9, 11 for positioning the carriages 3 along the cross-beam (4). Additionally mounted sensors can also be used to determine the temperature of the soft roll for the controlled metering of the water supply.

Although it is preferable to provide water film applying devices 7 at both ends of the soft roll 2 it is also entirely conceivable that only one such device is necessary and will be provided at only one end of the soft roll 2. Such an arrangement would be conceivable if, for example, the paper web is always guided so that the position of its one side edge is axially fixed relative to the soft roll. In this case the water film applying device need only be provided at the other end of the soft roll.

Alternatively only a single water applying device would be provided with two water outlets, one for each end of the roll. The appended claims will also be understood to cover such embodiments.

We claim:

1. A method of roll cooling in paper machines comprising the steps of feeding a paper web for calendering through at least one roll pair formed by a soft roll and a heated counter roll, extending a portion of the soft roll beyond a width of the paper web and cooling the soft roll by applying a thin and sharply bounded film of water to the portion of the soft roll.

2. Method in accordance with claim 1 including the step of blowing air onto the water film, after the step of applying the water film to the soft roll for evaporatively cooling it.

3. Method in accordance with claim 2 including the step of maintaining a water film thickness which precludes introduction of water into a gap between the rolls.

4. Method in accordance with claim 1 including the step of maintaining a water film thickness which precludes introduction of water into a gap between the rolls.

* * * * *